US009103262B2

(12) United States Patent
Prenger et al.

(10) Patent No.: US 9,103,262 B2
(45) Date of Patent: Aug. 11, 2015

(54) COMBINED INTAKE ASPIRATOR VENTURI TUBE AND WATER TRAP IN VERTICAL EXHAUST OUTLET STACK

(75) Inventors: Nicholas J. Prenger, Palos Heights, IL (US); Adupala Rajeshwar, Westmont, IL (US); Kain Knowles, Chicago, IL (US); Daniel A. Morey, Mundelein (IL); William H. Adamson, Naperville, IL (US)

(73) Assignee: CNH Industrial America LLC, New Holland, PA (US)

( * ) Notice: Subject to any disclaimer, the term of this patent is extended or adjusted under 35 U.S.C. 154(b) by 964 days.

(21) Appl. No.: 13/112,947

(22) Filed: May 20, 2011

(65) Prior Publication Data

US 2012/0124980 A1 May 24, 2012

Related U.S. Application Data

(60) Provisional application No. 61/417,125, filed on Nov. 24, 2010.

(51) Int. Cl.
*F01N 13/08* (2010.01)

(52) U.S. Cl.
CPC ..... *F01N 13/082* (2013.01); *F01N 13/085* (2013.01); *F01N 2450/22* (2013.01); *F01N 2470/30* (2013.01); *F01N 2590/08* (2013.01)

(58) Field of Classification Search
CPC . F01N 13/082; F01N 13/085; F01N 2450/22; F01N 2470/30; F01N 2590/08; F01N 3/05; F01N 1/08; F01N 3/005
USPC ..... 60/283, 309, 319, 324
See application file for complete search history.

(56) References Cited

U.S. PATENT DOCUMENTS

| | | | | |
|---|---|---|---|---|
| 2,717,049 | A | 9/1955 | Langford | |
| 3,672,464 | A | 6/1972 | Rowley et al. | |
| 4,197,703 | A * | 4/1980 | Holmes | 60/319 |
| 4,827,715 | A | 5/1989 | Grant et al. | |
| 5,170,020 | A | 12/1992 | Kruger et al. | |
| 5,174,113 | A | 12/1992 | Deville | |
| 5,321,215 | A | 6/1994 | Kicinski | |
| 5,808,245 | A | 9/1998 | Wiese et al. | |
| 7,713,493 | B2 | 5/2010 | Bosanec, Jr. et al. | |
| 7,721,530 | B2 * | 5/2010 | Holm | 60/283 |
| 2007/0113547 | A1 | 5/2007 | Thaler | |
| 2009/0084083 | A1 | 4/2009 | Vachon et al. | |
| 2010/0170231 | A1 | 7/2010 | Yamaguchi | |

FOREIGN PATENT DOCUMENTS

| | | | |
|---|---|---|---|
| GB | 2134979 | A | 8/1984 |
| GB | 2150218 | A | 6/1985 |
| JP | 2010127161 | A | 6/2010 |

* cited by examiner

*Primary Examiner* — Thomas Denion
*Assistant Examiner* — Diem Tran
(74) *Attorney, Agent, or Firm* — Sue C. Watson

(57) ABSTRACT

An integral water trap and venturi tube element for use in an exhaust stack on a vehicle, the exhaust stack being generally vertically oriented and having a catalyst element or other moisture-sensitive emission control component disposed below the water trap, the venturi tube having an aspirator tube disposed therein to provide a low pressure aspiration source for the vehicle, wherein the venturi tube is so disposed in the exhaust stack to also function as the water trap and allows capture and diversion of water entering the exhaust stack from above.

12 Claims, 3 Drawing Sheets

COMBINED INTAKE ASPIRATOR VENTURI TUBE AND WATER TRAP IN VERTICAL EXHAUST OUTLET STACK

This application claims the benefit of priority of U.S. Provisional Application 61/417,125, filed Nov. 24, 2010.

BACKGROUND OF THE INVENTION

The present invention relates to an exhaust stack for an off-road work vehicle, and more particularly to combined water trap and aspirator venturi tube structure for a vertical exhaust outlet stack.

Many off-road work vehicles, such as trucks, tractors, off-road equipment, and the like, utilize a vertical exhaust system, in which an exhaust outlet conduit extends vertically from the vehicle. Government regulations designed to reduce engine emissions have required the incorporation of catalytic converters and other moisture-sensitive components in the exhaust system. If such components are mounted in the vertical exhaust system, there is a possibility that water can enter the upper end of the exhaust system and flow downwardly into contact with the equipment, especially the catalytic converter unit, and potentially damage the components. It is known to providing a cover over the upwardly open end of the exhaust outlet to prevent water from entering the exhaust stack or to include a water trap within the vertical outlet stack to collect any water that enters the exhaust stack and direct it away from moisture-sensitiveF components.

Off-road work vehicles may also incorporate venturi tubes disposed within the exhaust outlet stack to produce a vacuum source which may be used for aspiration of moisture which may accumulate as potential contamination in other areas of the engine, particularly the air intake housing. A venturi tube is typically welded into the exhaust stack proximate to the discharge outlet to create a low pressure region in the exhaust stack. An aspirator tube having one end positioned in the low pressure region of the venturi tube and the other end located at a desired location requiring moisture removal provides a low pressure source for aspiration of any accumulated moisture.

Incorporating the above features into a vertical exhaust stack typically requires the addition of two separate structures: a water trap and a venturi tube. The result increases the internal complexity and expense of the exhaust stack as well as the potential for failure. Such increases are often economically intolerable in the competitive small tractor market sector.

It would be a great advantage to provide a single structure for incorporation into a vertical exhaust stack capable of redirecting water entering the stack to protect a catalyst integrated into the exhaust stack and creating the necessary low pressure source to drive a moisture removal aspirator that overcomes the above problems and limitations. Further advantages would be realized by a combined aspirator venturi tube and water trap that is easily incorporated into the vertical exhaust outlet stack of a variety of work vehicles. These and other objects are satisfied by the invention described below.

SUMMARY OF THE INVENTION

Accordingly, the present invention, in any of the embodiments described herein, may provide one or more of the following advantages:

It is an object of the present invention to provide a combined water trap and venturi tube for use in an exhaust stack on a vehicle, the exhaust stack being generally vertically oriented and having a catalyst element or other moisture-sensitive component disposed below the water trap, the venturi tube having an aspirator tube disposed therein to provide a low pressure aspiration source for the vehicle, wherein the venturi tube is so disposed in the exhaust stack to function as the water trap.

It is another object of the present invention to provide an integral venturi tube and water trap for use in an exhaust stack on a vehicle, the vehicle having a muffler body, one or more emission control components arranged within the muffler body, an adductor for removal of moisture from a location within the vehicle, and a water trap disposed within the exhaust stack, wherein the exhaust stack is generally vertically oriented, the water trap is disposed above the emission control components, and the relationship between the venturi tube and the exhaust stack forms the water trap.

It is another object of the present invention to provide a venturi tube for use in a generally vertically oriented exhaust stack, the exhaust stack having a catalyst element disposed below the venturi tube, wherein the venturi tube is attached to the exhaust stack in a manner to trap incoming moisture travelling downwardly along the interior of the exhaust stack and enable the moisture to be expelled from the stack before coming in contact with the catalyst element or other moisture-sensitive components installed in the exhaust system.

It is yet another object of the present invention to provide a combined venturi tube and water trap element for use in a generally vertically oriented exhaust stack that may be readily adapted to a wide range of exhaust stack sizes and configurations.

It is still another object of the present invention to provide a combined water trap and venturi tube element for use in a vehicle exhaust stack that produces a sufficiently low pressure to enable operation of an air intake moisture aspirator provided on the vehicle.

It is a still further object of the present invention to provide a combined water trap and venturi tube element for use in a generally vertically oriented vehicle exhaust stack that effectively traps and allows removal of a majority of the moisture that may enter the exhaust stack from above the element.

It is a still further object of the present invention to provide an integral venturi tube and water trap element for use in a generally vertically oriented exhaust stack on a vehicle, the exhaust stack having a catalytic converter element disposed within the portion of the stack and below the element that is durable in construction, inexpensive of manufacture, carefree of maintenance, easily assembled, and simple and effective to use.

These and other objects are achieved by providing an integral water trap and venturi tube element for use in an exhaust stack on a vehicle, the exhaust stack being generally vertically oriented and having a catalyst element disposed below the water trap, the venturi tube having an aspirator tube disposed therein to provide a low pressure aspiration source for the vehicle, wherein the venturi tube is so disposed in the exhaust stack to also function as the water trap and allows capture and diversion of water entering the exhaust stack from above.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "left" or "right," "up" or "down," or "top" or "bottom" are used as a matter of mere convenience, and are determined by standing at the rear of the machine facing in its normal direction of travel. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
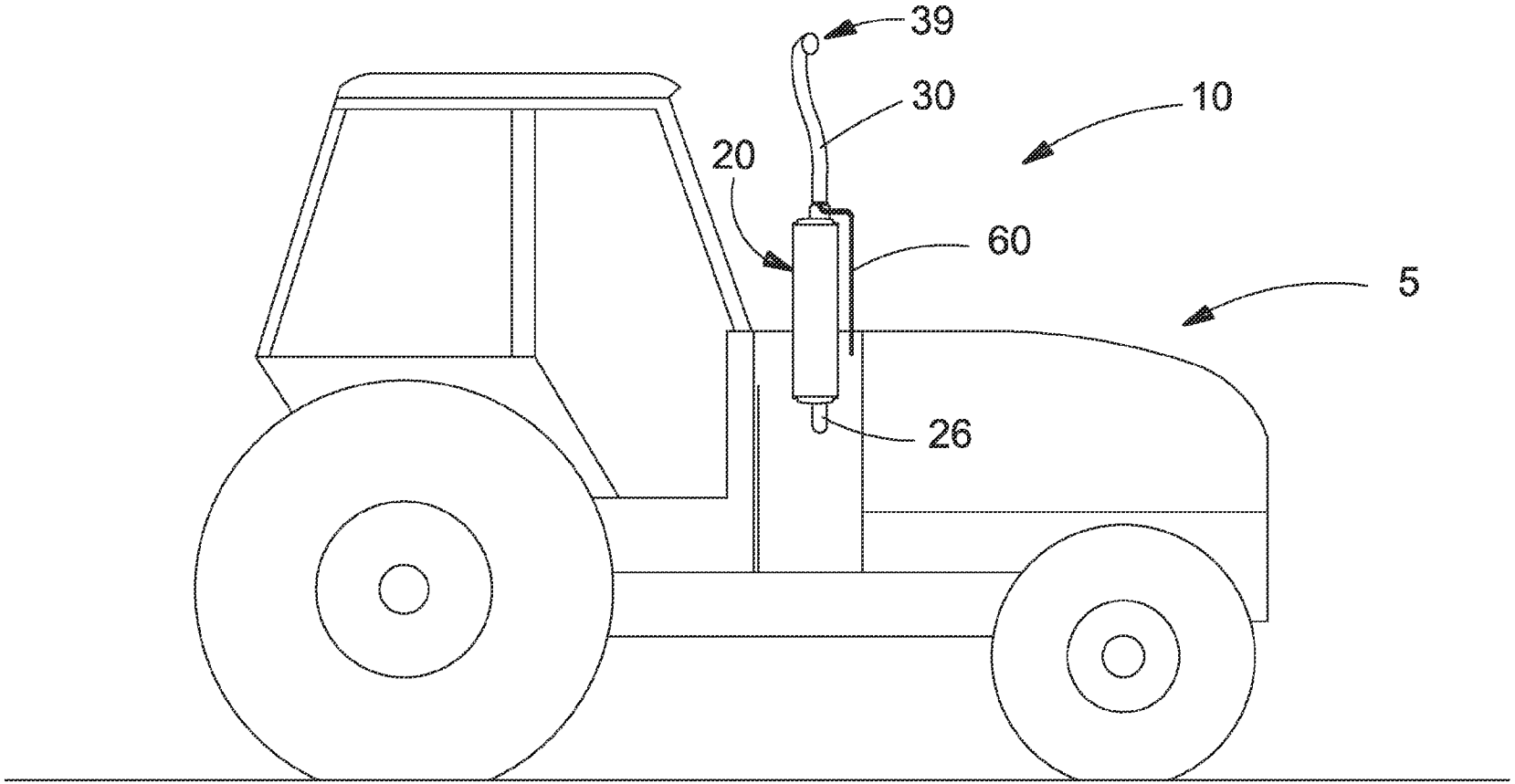
FIG. 1 is a schematic side view of a work vehicle of the type on which the present invention is useful.

First referring to FIG. 1, there is illustrated a work vehicle 5 including an engine (not shown) and an exhaust system 10 for expulsion of combustion gasses from the engine. Exhaust system 10 includes a vertical mount catalytic converter muffler generally illustrated at 20 which may hereinafter be referred to as an SCR muffler assembly 20 for convenience. Additional moisture-sensitive emission control components, such as nitrogen oxide (NOX) sensors, may also be installed in the SCR muffler assembly. Exhaust system 10 also includes an exhaust outlet stack 30 which extends generally vertically upwardly from the muffler assembly.

As is easily understood to one skilled in the art, the muffler assembly according to the present invention is constructed to operate effectively and efficiently both as an exhaust noise muffler and as a catalytic converter. The principles of noise attenuation and selective catalytic reduction (SCR) of internal combustion engine exhaust streams are well known and not discussed further herein except to note the importance of keeping the catalytic element with the muffler assembly generally free of moisture contamination in order to maintain optimal performance.

Figure 2:
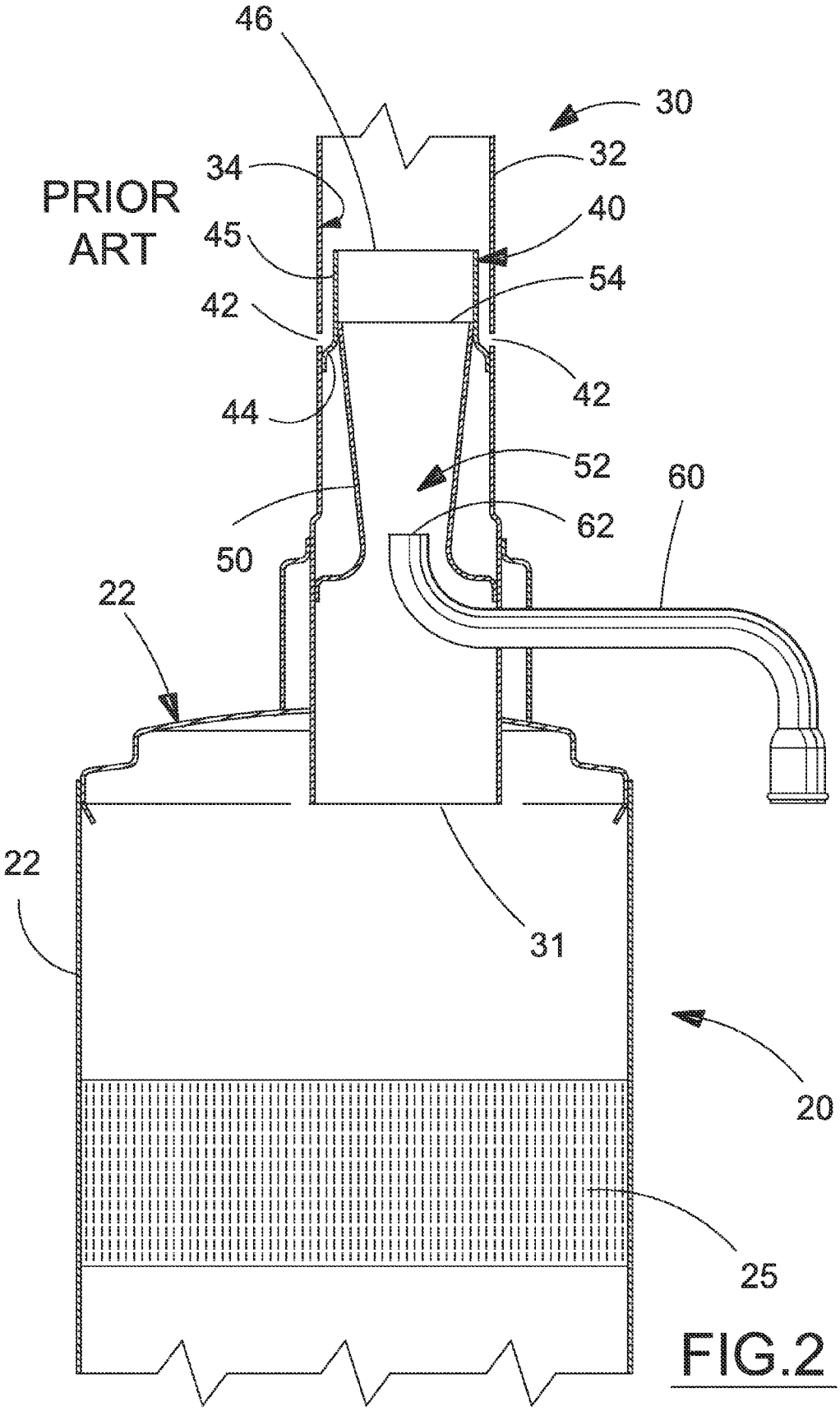
FIG. 2 is a detailed view of a portion of the exhaust stack on the work vehicle showing the known configuration for providing a water trap and a aspiration venturi tube in the exhaust stack.

Continuing to refer to FIG. 1, but now in conjunction with FIG. 2 wherein a portion of the muffler assembly 20 and exhaust outlet stack 30 is shown to include a muffler housing 22 and an outlet pipe 34. Housing 22 may be generally cylindrically configured and vertically oriented. Exhaust gasses are conveyed from the engine to the muffler assembly though a connector pipe 26. Exhaust gasses enter from below and flow upwardly into the muffler assembly 20 wherein sound is attenuated and the gasses are treated by contact with a catalyst element 25 disposed within the muffler housing 22. An opening is provided at the top of the muffler housing 22 through which a portion of the exhaust stack 30 extends to allow the gasses to be exhausted from the muffler housing 22. It is noted that the stack 30 may comprise several individual portions that combine to provide an enclosed conduit for exhaust gasses from the muffler housing to a position away from the housing. As shown, the exhaust stack 30 comprises a primary pipe 32 extending into the muffler housing 22 and terminating with an inlet opening 31 into which exhaust gasses may flow to exit the muffler housing.

Exhaust stack 30 extends upwardly and is open to the atmosphere and is, as such, it is susceptible to water inleakage. Exhaust stack 30, as illustrated in FIG. 1, is configured such that water which enters the discharge outlet 39 is directed into contact with the interior surface 34 of the exhaust pipe wall 32. As a result of the generally vertical orientation of the exhaust pipe wall 32, water on the interior surface 34 flows downward toward the muffler assembly 20, especially if the engine is not operating and the exhaust system is cool.

Moisture must not be allowed to enter a SCR muffler assembly while the engine is not operating. Upon subsequent engine startup, water quickly evaporates and jeopardizes the internal substrate of the catalyst. In order to prevent water intrusion on the catalyst element 25, a water trap 40 is provided in the lower portion of the exhaust stack 30. The water trap comprises a vertically extending wall 45 which is inwardly spaced apart from the interior surface 34 of the exhaust pipe wall 32 to form an annular opening. The lower portion of the wall 45 is flared outward so that it contacts the interior surface 34 to form a seal boundary 44. Gravity drawn moisture travelling down the interior surface 34 will thus be collected in the annular trough formed between the interior surface and the water trap 40. A plurality of apertures 42 is provided around the circumference of and extending through the exhaust pipe wall 32 slightly above the seal boundary 44 to allow trapped water to be discharged from the exhaust pipe.

Also shown in FIG. 2 is a venturi tube 50 disposed within the exhaust stack 30. Off road vehicles may benefit from moisture aspirators to remove accumulated moisture from intake air cleaner and pre-cleaner housings to prevent ingestion by the engines. The operation of venturi tubes is well known; by disposing venturi tube 50 in the stream of relatively high velocity exhaust gasses, a low pressure region is created in the throat region 52. Aspirator tube 60 is positioned to have a first opening 62 located in the throat region 52 thereby creating a slight vacuum in the aspirator tube 60. The other end of aspirator tube 60 is commonly positioned in a low point within the air cleaner or air pre-cleaner housing of the vehicle such that it will draw any moisture present toward the low pressure throat region 52 when the engine is operating and allow the moisture to be discharged in the exhaust stream.

In the prior art embodiment shown, the lower flange 56 of venturi tube 50 is connected to the interior surface 34 of the exhaust pipe. The connection is structural and need not be sealed as some bypass of gasses around the venturi throat does not significantly affect performance. The upper end 54 of the venturi tube may be connected to the water trap 40 (as shown) or alternatively directly to the interior surface 34. The result is that in an exhaust stack requiring both a water trap 40 and a venturi tube 50, multiple structures are required to be inserted and welded into position within the confines of the exhaust pipe 32.

Figure 3:
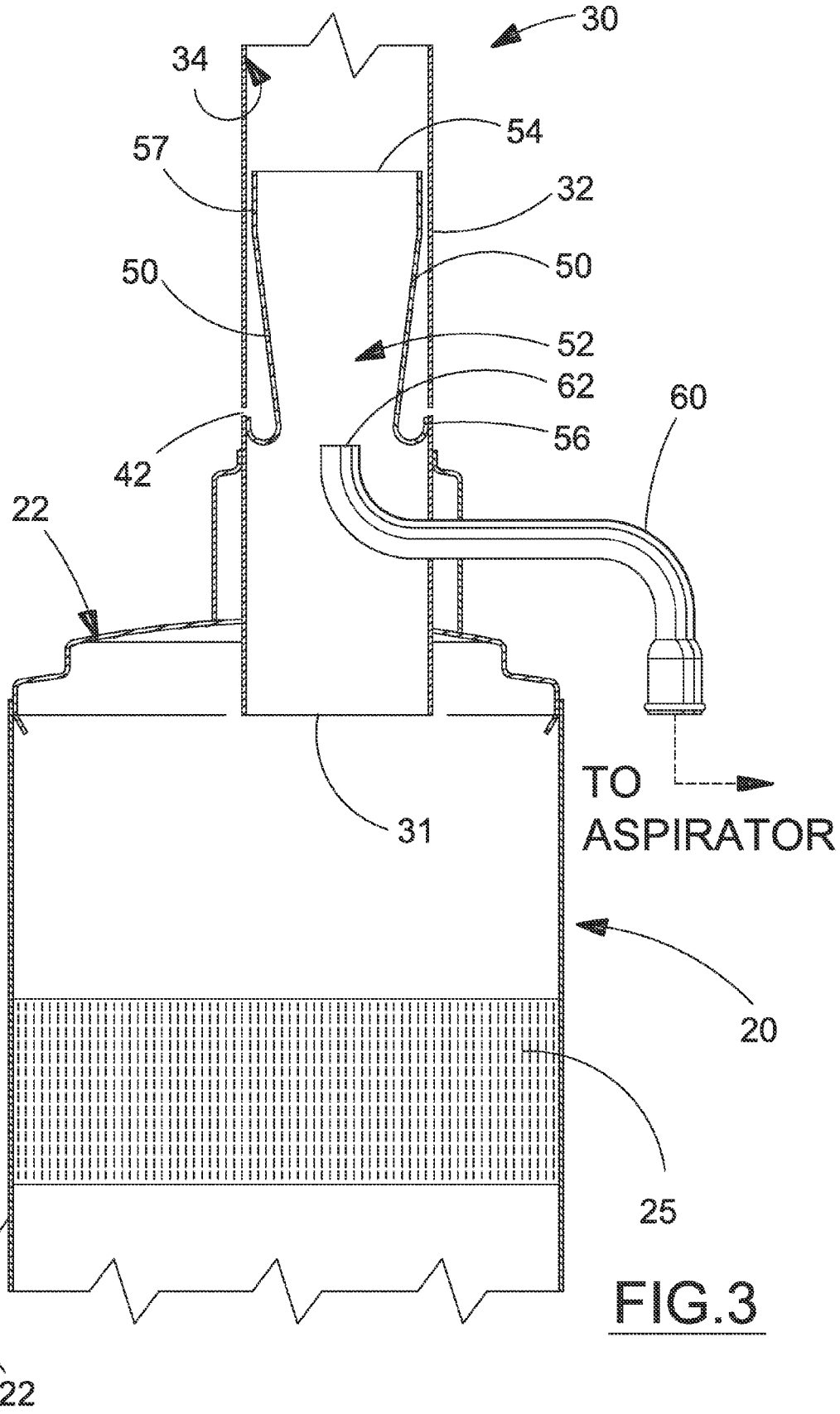
FIG. 3 is a detailed view of a portion of the exhaust stack on the work vehicle showing one embodiment of a combined venturi tube and water trap of the present invention.

Finally referring to FIG. 3, the present invention simplifies the exhaust stack assembly by reconfiguring the venturi tube 50 to also function as the water trap. The upper end 54 of venturi tube 50 is configured to be slightly smaller in diameter that in the exhaust pipe 32 thus creating an annular opening between interior surface 34 and the upper portion 57 of the venturi tube 50 through which moisture migrating along interior surface 34 may be allowed to pass. The lower flange 56, an integral part of the venturi tube 50, is connected to the interior surface 34 as in the earlier described configuration, but the connection is now circumferentially sealed, preferably by a seal weld, to prevent the seepage of moisture below the connection. Water is thus contained between the exterior of the venturi tube 50 and the interior surface 34. As in the earlier described configuration, a plurality of apertures 42 is provided around the circumference of and extending through the exhaust pipe wall 32 slightly above the sealed boundary between the lower flange 56 and the interior surface 34 to allow trapped water to be discharged from the exhaust pipe thereby protecting the catalyst below from moisture damage. The aspirator tube 60 relationship with the throat 52 of the venturi tube 50 is unchanged.

Use of the venturi tube structure 50 as both an aspirator low pressure source and a water trap dramatically simplifies the internal configuration of the exhaust stack. A single insert may now replace what was previously multiple discreet component structures thereby lowering material and assembly costs. A full circumferential seal weld between the lower flange 56 of the venturi tube 50 and the exhaust pipe 32 should improve durability of the connection compared to a spot-welded attachment. Further, the present invention reduces the welded connections from nominally three to one which should further improve durability. Simplification of the insert will also enable the present invention to be more readily adapted for use in a wider range of exhaust stacks.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the inventions.

Having thus described the invention, what is claimed is:

1. An exhaust system for a work vehicle comprising:

an elongated, generally cylindrical exhaust stack having a lower end configured to receive exhaust gas from an internal combustion engine, a generally opposing upper end configured to expel exhaust gas into the atmosphere, and a stack wall;

a venturi insert having a lower inlet end, an upper discharge end, and a throat therebetween, the venturi insert configured to fit within the exhaust stack wall thereby forming an annular space thereabout;

a continuous, circumferential flange connecting the venturi insert to the stack wall, the circumferential flange connecting to the venturi insert adjacent to the lower inlet end in a manner forcing exhaust gas to pass through the throat in order to be expelled into the atmosphere, wherein the upper discharge end of the venturi insert is not connected to the stack wall;

an aspirator tube penetrating the stack wall and having a first open end positioned relative to the throat to produce a relative vacuum within the aspirator tube when exhaust gas flows through the venturi insert; and at least one penetration through the stack wall and positioned above the circumferential flange, thereby enabling moisture flowing downwardly along the interior of the stack wall to be collected atop the circumferential flange and expelled from the exhaust stack through the at least one penetration.

2. The exhaust system of claim 1, wherein the circumferential flange is integral to the venturi insert.

3. The exhaust system of claim 2, wherein the outer diameter of the upper discharge end is less than the inner diameter of the exhaust stack.

4. The exhaust system of claim 3, wherein the upper end is configured to cause water entering the upper end to contact the interior surface of the stack wall at a position above the venturi insert.

5. The exhaust system of claim 4, wherein the aspirator tube is in pressure communication with a vehicle air intake system and configured to draw moisture from the air intake system toward the first open end when exhaust gas flows through the venturi insert.

6. A combined intake aspirator venturi tube and water trap for a vertical exhaust outlet stack on a work vehicle comprising:

a generally cylindrical exhaust stack having a lower end configured to receive exhaust gas from an internal combustion engine, a generally opposing upper end configured to expel exhaust gas into the atmosphere, and a stack wall enclosing an exhaust gas passageway therebetween;

a venturi insert having a lower inlet end with a continuous, circumferential flange extending therefrom defining a peripheral edge, an upper discharge end, and an open throat portion extending between the inlet end and the discharge end, the venturi insert configured to fit within the exhaust stack wall and be connected to the stack wall by a continuous, circumferential connection between the peripheral edge and the stack wall, wherein the upper discharge end of the venturi insert is not connected to the stack wall;

an aspirator tube penetrating the stack wall and having a first open end positioned relative to the throat to produce a relative vacuum within the aspirator tube when exhaust gas flows through the venturi insert; and at least one penetration through the stack wall and positioned above the circumferential flange, thereby enabling moisture flowing downwardly along the interior of the stack wall to be collected atop the circumferential flange and expelled from the exhaust stack through the at least one penetration.

7. The combined intake aspirator venturi tube and water trap of claim 6, wherein the outer diameter of the upper discharge end is less than the inner diameter of the exhaust stack thereby forming an annular space therebetween.

8. The combined intake aspirator venturi tube and water trap of claim 7, wherein the upper end is configured to cause water entering the upper end to contact the interior surface of the stack wall at a position above the venturi insert.

9. The combined intake aspirator venturi tube and water trap of claim 8, wherein the aspirator tube is in pressure communication with a vehicle air intake system and configured to draw moisture from the air intake system toward the first open end when exhaust gas flows through the venturi insert.

10. An exhaust system for a work vehicle, the exhaust system having a generally vertically oriented exhaust outlet stack positioned above a moisture-sensitive exhaust treatment element, the exhaust system comprising:

a generally cylindrical exhaust stack having a lower end configured to receive exhaust gas from an internal combustion engine, a generally opposing upper end configured to expel exhaust gas into the atmosphere, and a stack wall enclosing an exhaust gas passageway therebetween;

a venturi insert having a lower inlet end with a continuous, circumferential flange extending therefrom defining a peripheral edge, an upper discharge end, and an open throat portion extending between the inlet end and the discharge end, the venturi insert configured to fit within the exhaust stack wall and be connected to the stack wall by a continuous, circumferential connection between the peripheral edge and the stack wall in a manner forcing exhaust gas to pass through the open throat portion in order to be expelled into the atmosphere, the upper discharge end fitting within the stack wall and forming an annular opening therebetween, wherein the upper discharge end of the venture insert is not connected to the stack wall; and at least one penetration through the stack wall and positioned above the circumferential flange, thereby enabling moisture flowing downwardly along the interior of the stack wall to be collected atop the circumferential flange and expelled from the exhaust stack through the at least one penetration.

11. The exhaust system of claim 10, further comprising an aspirator tube penetrating the stack wall and having a first open end positioned relative to the throat to produce a relative vacuum within the aspirator tube when exhaust gas flows through the venturi insert, the aspirator tube in pressure communication with a vehicle air intake system and configured to draw moisture from the air intake system toward the first open end when exhaust gas flows through the venturi insert.

12. The exhaust system of claim 11, wherein the upper end is configured to cause water entering the upper end to contact the interior surface of the stack wall at a position above the venturi insert.

* * * * *